US009339860B2

(12) United States Patent
Denkmeier

(10) Patent No.: US 9,339,860 B2
(45) Date of Patent: May 17, 2016

(54) PRODUCTION SYSTEM, IN PARTICULAR FOR FREE-FORM BENDING, HAVING AN INTEGRATED WORKPIECE AND TOOL MANIPULATOR

(75) Inventor: Thomas Denkmeier, Traun (AT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 438 days.

(21) Appl. No.: 13/508,806

(22) PCT Filed: Nov. 9, 2010

(86) PCT No.: PCT/AT2010/000432

§ 371 (c)(1),
(2), (4) Date: Jul. 19, 2012

(87) PCT Pub. No.: WO2011/057312

PCT Pub. Date: May 19, 2011

(65) Prior Publication Data

US 2012/0279275 A1 Nov. 8, 2012

(30) Foreign Application Priority Data

Nov. 10, 2009 (AT) ..... A 1777/2009

(51) Int. Cl.

| | |
|---|---|
| ***B21D 5/02*** | (2006.01) |
| ***B21D 37/04*** | (2006.01) |
| ***B21D 37/14*** | (2006.01) |
| ***B21D 43/00*** | (2006.01) |

(52) U.S. Cl.

CPC ..... *B21D 5/0209* (2013.01); *B21D 5/02* (2013.01); *B21D 5/0254* (2013.01); *B21D 37/04* (2013.01); *B21D 37/14* (2013.01); *B21D 43/00* (2013.01)

(58) Field of Classification Search

USPC ..... 72/380, 381, 389.1–389.3, 405.09, 72/405.12, 405.13, 405.15, 405.16, 419, 72/420, 422, 426; 414/222.01, 225.01, 414/226.02, 618, 621, 749.1, 751.1, 753.1

See application file for complete search history.

(56) References Cited

U.S. PATENT DOCUMENTS 5,555,763 A * 9/1996 Takeshita ..... 72/420
5,878,619 A * 3/1999 Walczak ..... 72/381

(Continued)

FOREIGN PATENT DOCUMENTS

| | | |
|---|---|---|
| AT | 506 296 | 8/2009 |
| CH | 668 035 | 11/1988 |

(Continued)

OTHER PUBLICATIONS

International Search Report of PCT/AT2010/000432, Mar. 2, 2011.

*Primary Examiner* — Shelley Self
*Assistant Examiner* — Pradeep C Battula
(74) *Attorney, Agent, or Firm* — Collard & Roe, P.C.

(57) ABSTRACT

The invention relates to a production system (1) for free-form bending. It includes a bending press (3) with bending tools (4) which are interchangeably held in tool holders (19, 20), a manipulator (28) with gripping tongs (30) having gripping fingers (31, 32), and a recess (35, 36) disposed in the bending tool (4) with stop regions (49, 50) disposed at a distance apart from one another for manipulating the bending tool (4). Additional contact surfaces (40) are provided on ends (38, 39) of the gripping fingers (31, 32) on sides of the gripping fingers (31, 32) facing away from one another. The ends (38, 39) of the gripping fingers (31, 32) are inserted in the recess (35, 36) in order to hold the bending tool (4). The contact surfaces (40) are pressed against the stop regions (49, 50) in the direction opposite the clamping force for holding the workpiece (2) to be produced.

19 Claims, 6 Drawing Sheets

(56) References Cited

U.S. PATENT DOCUMENTS

| | | | | |
|---|---|---|---|---|
| 5,950,485 | A * | 9/1999 | Sartorio | 72/422 |
| 6,656,099 | B1 * | 12/2003 | Akami et al. | 72/446 |
| 7,080,534 | B2 * | 7/2006 | Schneiderheinze | 72/389.3 |
| 7,784,317 | B2 * | 8/2010 | Denkmeier et al. | 72/21.3 |
| 8,424,359 | B2 * | 4/2013 | Theis et al. | 72/420 |
| 2006/0179913 | A1 | 8/2006 | Strasser | |
| 2007/0018370 | A1 | 1/2007 | Reissenweber | |
| 2007/0297889 | A1 * | 12/2007 | Rouweler et al. | 414/733 |
| 2009/0090155 | A1 | 4/2009 | Coopman | |

FOREIGN PATENT DOCUMENTS

| | | | |
|---|---|---|---|
| CN | 1990171 | A | 7/2007 |
| CN | 201183091 | Y | 1/2009 |
| DE | 20 2004 020 404 | | 5/2005 |
| EP | 0 555 908 | | 8/1993 |
| EP | 0619151 | A1 | 6/1994 |
| EP | 1 160 024 | | 12/2001 |
| EP | 1772204 | A1 | 4/2007 |
| EP | 1 862 255 | | 12/2007 |
| JP | 05-293552 | | 11/1993 |
| JP | 06-234018 | | 8/1994 |
| JP | 6-344034 | | 12/1994 |
| JP | 2004-202527 | | 7/2004 |
| JP | 2005-074446 | | 3/2005 |
| JP | 2005/319491 | | 11/2005 |
| WO | WO 2004/108322 | | 12/2004 |
| WO | WO 2006/122379 | | 11/2006 |
| WO | WO 2009/072661 | | 6/2009 |

* cited by examiner

PRODUCTION SYSTEM, IN PARTICULAR FOR FREE-FORM BENDING, HAVING AN INTEGRATED WORKPIECE AND TOOL MANIPULATOR

CROSS REFERENCE TO RELATED APPLICATIONS

This application is the National Stage of PCT/AT2010/000432 filed on Nov. 9, 2010 which claims priority under 35 U.S.C. §119 of Austrian Application No. A 1777/2009 filed on Nov. 10, 2009, the disclosure of which is incorporated by reference. The international application under PCT article 21(2) was not published in English.

The invention relates to a production system, in particular for free-form bending workpieces to be produced from sheet metal, of the type defined in claim 1.

EP1 862 255 A1 discloses a tool changing system for a bending tool, for which a separate manipulator is provided as a means of manipulating the bending tool. The latter has a pin-shaped lug which is inserted in a special recess of the bending tool for manipulation purposes. A separate manipulator pin is needed for this purpose, which is used exclusively to manipulate the bending tool. The clamp of the bending tool whilst retained in the tool holder can be released either by means of this manipulator pin or by an additional manipulator pin. This may be done either mechanically by means of the additional manipulator pin or alternatively by opting for a design of the first manipulator pin operated by pressurizing medium.

JP 06-234018 describes a different tool changing system for bending tools, for which a separate gripper is provided as a means of manipulating the metal sheet in order to form the workpieces. The bending tools are manipulated by means of an additional manipulator element, which has two mutually spaced apart pin-shaped extensions which are inserted in complementary recesses of the bending tool in order to manipulate the latter. In the case of this design, it is not possible to use the same gripper fingers by which the metal sheet is manipulated to manipulate the bending tool as well.

JP 05-293552 describes a tool changing system with different fixtures for the manipulator. With one of the fixtures, it is possible to grip and retain the metal sheets in order to manipulate them as far as the tool used in the production process, and with another fixture, the bending tools are able to grip elements projecting out from it so as to be manipulated. This again means that different fixtures are needed in order to manipulate the workpieces and the bending tools.

Another tool changing system is known from EP 1 160 024 A1, and in this case an orifice is provided in the bending tool through which a separate gripping arm can be inserted and fed. Relative positioning takes place by means of a shoulder of the gripping arm on the one hand, and the clamping mechanism in the region of the headpiece of the bending tool is released by means of a retaining arm which is guided as it moves in the axial direction of the recess. Here again, it is necessary to provide a separate manipulator arm for manipulating the bending tool.

The underlying objective of this invention is to propose a tool changing system for bending tools of a production system which is designed so that the bending tools can be readily changed on an automated basis, thereby enabling adaptation to them at little cost and effort.

This objective of the invention is achieved by means of the features defined in claim 1. The advantage achieved as a result of the features defined in claim 1 resides in the fact that by providing and incorporating a recess in the bending tool and designing the ends of the gripping fingers of the manipulator accordingly, it is possible not only to hold and manipulate the metal sheet to be processed as far as the finished workpiece, but also to hold and manipulate the bending tool with the same gripping fingers. By opting to dispose the recess in the region of the bending tool, there is no need to provide any additional parts or parts projecting from it for manipulation purposes. By opting for an appropriate shape of the recess, there is also no need for special tools to permit insertion in the recess to enable it to be manipulated. This enables the metal sheet and the workpiece being formed from it to be held merely on the basis of a simple clamping movement of the two gripping fingers in a direction of movement towards one another on the one hand, and also enables the bending tool to be held and manipulated by nothing more than a movement of the same gripping fingers in the opposite direction on the other hand. This means that it is no longer necessary to provide either separate manipulators for the process of manipulating bending tools, nor is it necessary to even produce gripping fingers or manipulating tools separately for them, which would then have to be operated separately.

Another embodiment defined in claim 2 is also of advantage because in conjunction with the gripping fingers of the gripping tongs, a sufficient hold of the bending tool is guaranteed, even in the event of tilting movements. Furthermore, a holding and clamping position similar to that which occurs during normal clamping of the metal sheets is assumed.

Also of advantage is an embodiment defined in claim 3 because it ensures correct pre-centering just before the end of the clamping operation already, thereby ensuring that there can be no turning between the gripping fingers and the bending tool.

As a result of the design defined in claim 4, the tools held in the tool holders can be changed directly and without complicating angular movements of the manipulator.

As a result of another embodiment defined in claim 5, the bending tool is held and supported on the gripping fingers with virtually no tilting moment.

Also of advantage is another embodiment defined in claim 6 because a certain tolerance is obtained, within which the gripping fingers can be inserted in the recess of the bending tool and firmly clamped on it.

The advantage of the embodiment defined in claim 7 is that the processing used to produce the recess is made significantly easier and less expensive.

As a result of the embodiment defined in claim 8, an approximately scissor-type abutment of the supporting region on the external face of the gripping fingers is achieved, thereby making it more difficult for the bending tool to slip off or slide off the gripping fingers. Furthermore, by opting for a complementary design of the contact surfaces of the gripping fingers, a locking or coupling with one another based on a positive fit can be obtained to a certain degree.

The embodiment defined in claim 9 results in universal handling and manipulation of the bending tools.

Also of advantage is an embodiment defined in claim 10 because the bending tool can be gripped and held on both sides, which makes manipulation much easier.

Finally, an embodiment of the type described in claim 11 is also of advantage because it results in even better mutual centering during the holding operation.

To provide a clearer understanding, the invention will be described in more detail with reference to the appended drawings.

These are schematically simplified diagrams illustrating the following:

Figure 1:
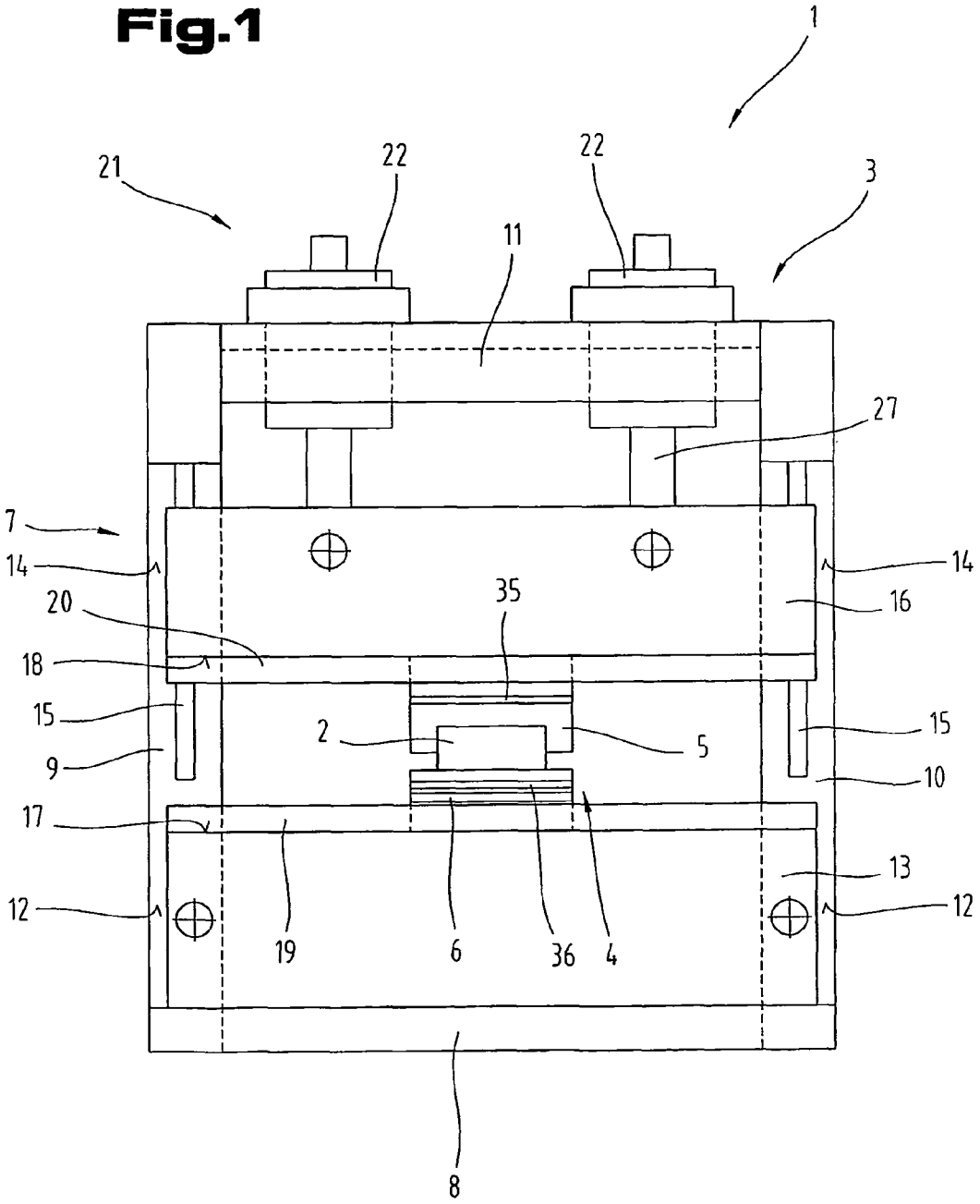
FIG. 1 is a view of a bending press of the production system proposed by the invention.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

Figure 2:
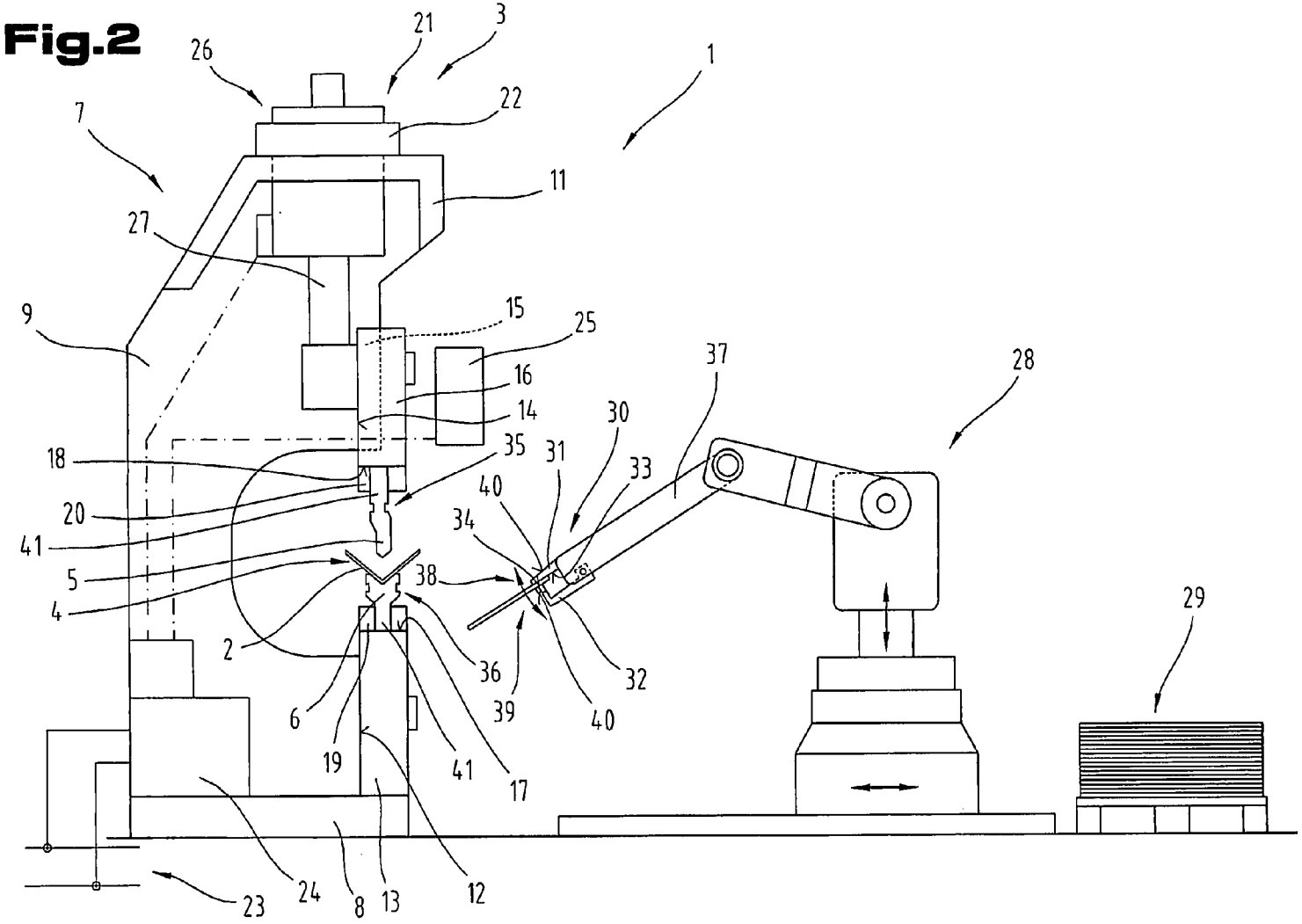
FIG. 2 is a side view of the bending press illustrated in FIG. 1 and a schematically indicated manipulator.

FIGS. 1 and 2 are highly schematic, simplified diagrams illustrating a production system 1 for the free-form bending of workpieces 2 to be produced from sheet metal.

The production system 1 comprises a bending press 3, in particular a press brake, for producing workpieces 2 and parts between bending tools 4 which can be displaced relative to one another, such as a bending punch 5 and a bending die 6.

A machine frame 7 of the bending press 3 comprises, for example, a base plate 8, standing up vertically on which are side panels 9, 10 spaced at a distance apart from one another and oriented parallel with one another. The latter are preferably connected to one another at their end regions spaced at a distance apart from the base plate 8 by means of a solid cross-member 11 made from a formed sheet metal part.

The side panels 9, 10 are of an approximately C-shaped design in order to form a space for forming the workpiece, and a stationary pressing beam 13, in particular a bench beam, standing on the base plate 8 is secured to front end faces 12 of legs of the side panels 9, 10 close to the ground. Mounted on front end faces 14 of legs disposed at a distance from the base plate 8 is another pressing beam 16 which can be displaced in a movement guided in linear guides 15 relative to the pressing beam 13 constituting the bench beam, in particular a pressure beam. Disposed on mutually opposite end faces 17, 18 of the two pressing beams 13, 16 extending parallel with one another are tool holders 19, 20 on which the bending tools 4 are fitted.

The bending press 3 illustrated has a drive arrangement 21 for the displaceable pressing beam 16, namely the pressure beam, in the form of two drive means 22 driven by electrical energy, which are hard-wired to a control device 24 supplied from a power network 2. Operation of the bending press 3 is controlled via an input terminal 25 hard-wired to the control device 24.

The drive means 22 are electric motor-driven spindle drives 26 of a generally known type, actuator means 27 of which are drivingly connected to the top pressing beam 16 constituting the pressure beam, for example, to effect a reversible positioning movement of the latter.

Details of other elements needed to operate a bending press 3 of this type, such as safety equipment, stop arrangements, control and measuring units, will not be given in this description to avoid making the description unnecessarily long.

The production system 1 further comprises a manipulator 28 illustrated on a very simplified basis in FIG. 2, which takes at least one piece from a schematically indicated supply stack 29 of metal sheets to be formed and bent and moves it into the working area of the bending press 3. The manipulator 28 in turn comprises gripping tongs 30, also schematically illustrated, which in turn have gripping fingers 31, 32. The gripping fingers 31, 32 each have clamping surfaces 33, 34 on the side facing the workpiece 2 to be produced. By an appropriate pivoting movement of the gripping fingers 31, 32 towards one another and by applying sufficient clamping force, the sheet or the workpiece 2 to be produced is held by the manipulator 28 due to the co-operation of the clamping surfaces 33, 34, and moved accordingly as well as positioned. The gripping fingers 31, 32 of the gripping tongs 30 guarantee a corresponding gripping action and subsequently, due to the clamping movement, an adequate hold for the workpiece 2 to be produced from the metal sheet.

Also illustrated on a simplified basis is the fact that the bending tools 4, in particular the bending punch 5 and/or the bending die 6, have separate recesses 35, 36 to enable them to be manipulated. By manipulation of the bending tool 4 in this context is meant that the latter is removed from a tool mount, not illustrated, on an automated basis and automatically inserted in the tool holders 19, 20 of the pressing beam 13, 16. This could also be described as a tool changing system. In order to change corresponding bending tools 4, the bending tools 4, having been gripped in a clamping hold, are pushed or pulled out of the tool holders 19, 20, usually in the longitudinal direction thereof and replaced by other bending tools 4. The bending tools 4 being replaced are then returned to the tool depot and set down in a sorted arrangement so that they can be removed from there again for another bending operation and inserted in the tool holder 19, 20. The recesses 35, 36 in the bending tool 4 are used for this purpose. The clamping hold of the individual bending tools 4 in this instance takes place on the basis of a co-operation of the recesses 35, 36 disposed in the bending tool 4 and the gripping fingers 31, 32 of the gripping tongs 30.

Figure 3:
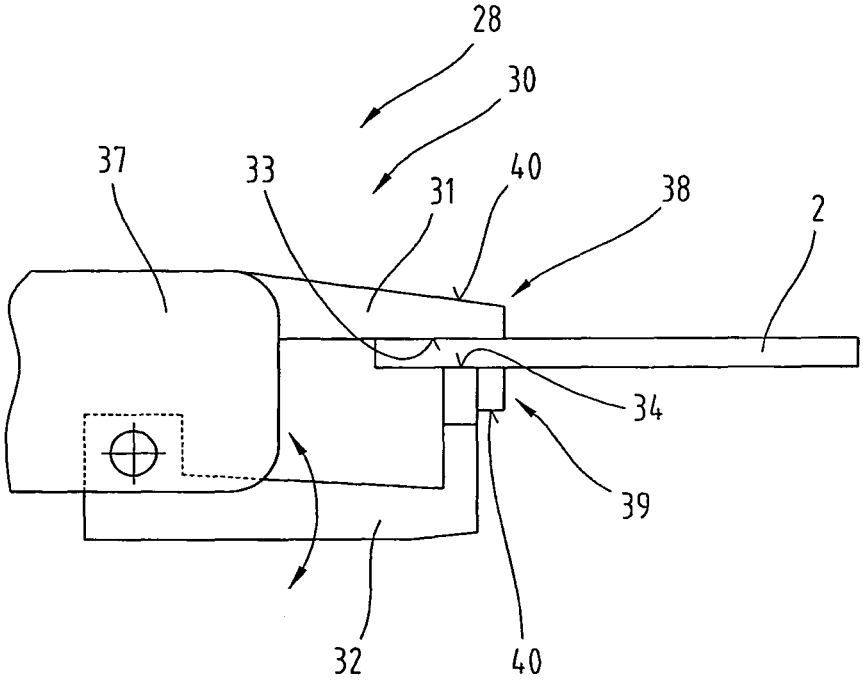
FIG. 3 is a diagram on a larger scale illustrating the gripping tongs of the manipulator illustrated in FIG. 2.

FIG. 3 illustrates the gripping tongs 30 mentioned above but on a larger scale to provide greater clarity and shows the two gripping finger 31, 32 with the mutually facing clamping surfaces 33, 34. The same reference numbers and component names as those used in connection with FIGS. 1 and 2 above are used to denote parts that are the same. To avoid unnecessary repetition, reference may be made to the detailed description given above with reference to FIGS. 1 and 2 above.

The workpiece 2 to be produced from the metal sheet is illustrated in a clamped position between the two gripping fingers 31, 32 and lying against the two clamping surfaces 33, 34 in this instance. In the example illustrated here, the gripping finger 31 is stationary, for example, whilst the other gripping finger 32 is mounted so that it can be pivoted relative to it on a manipulator arm 37. The pivoting movement takes place in a pre-definable plane and the pivoting direction is indicated by means of a double arrow. However, it would also be possible for the two gripping fingers 31, 32 to be pivoted towards one another.

To enable not only the metal sheet used to form the workpiece 2 to be gripped and held with the same gripping tongs 30, the latter are also provided as a means of enabling the bending tools 4 to be manipulated as well. To this end, an additional contact surface 40 is provided respectively at each end 38, 39 of the two gripping fingers 31, 32 on sides of the clamping surfaces 33, 34 facing away from one another.

In order to obtain a clamping action of the metal sheet in readiness for forming the workpiece 2, one or both of the gripping fingers 31, 32 of the gripping tongs 30 are moved towards one another so that the distance between the clamping surfaces 33, 34 is reduced to the degree that the metal sheet is clamped between them by its thickness.

In order to manipulate the bending tools 4, the ends 38, 39 of the gripping finger 31, 32 are inserted in the recesses 35 or 36 of the bending tool 4 and the clamping hold on the bending tool 4 is effected in the opposite direction from the clamping action of the workpiece 2. A description of the possible design of the recess 35, 36 will be given in more detail with reference to the subsequent drawings.

Figure 4:
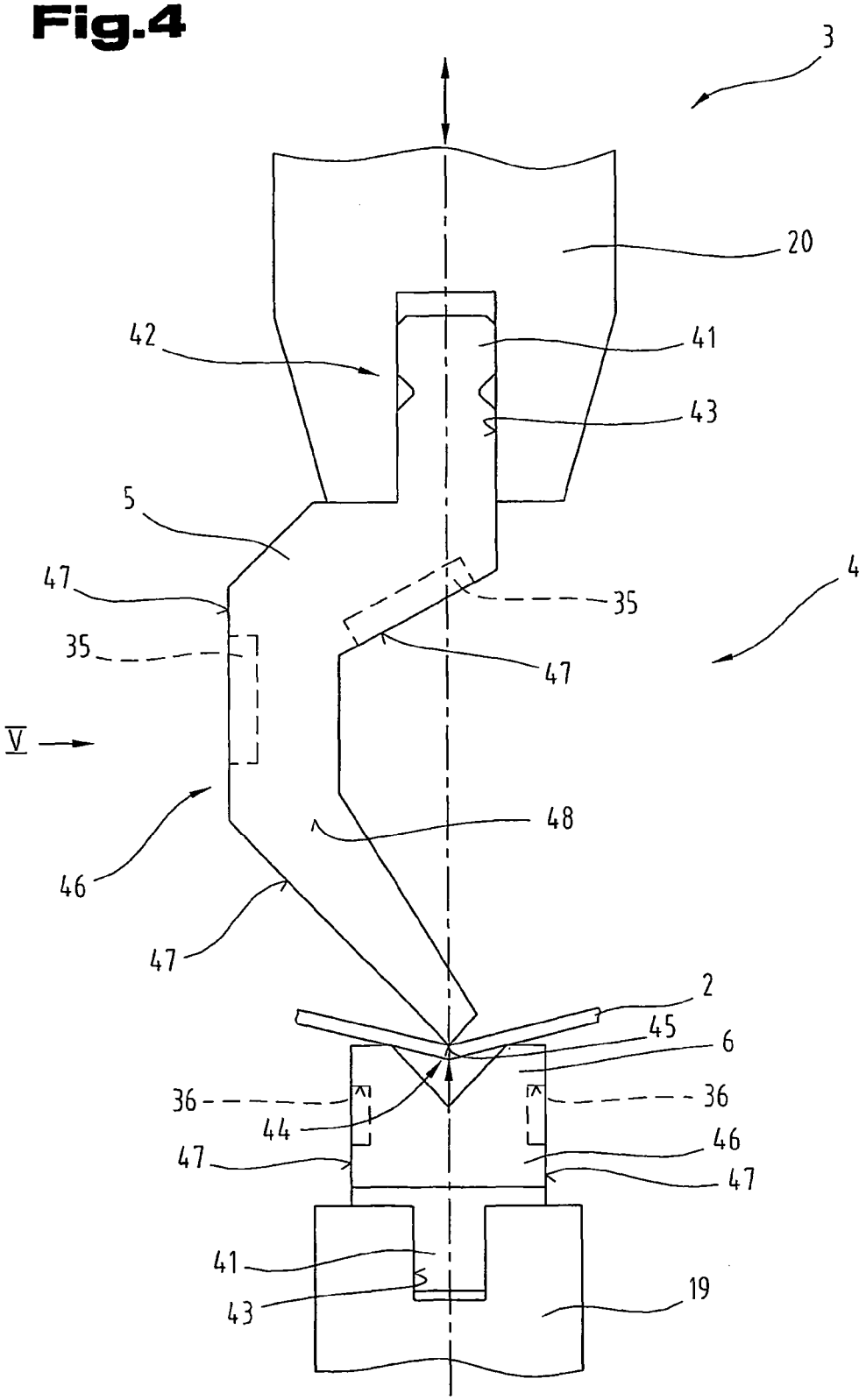
FIG. 4 is a side view on a larger scale illustrating a part-section of the bending press illustrated in FIGS. 1 and 2 in the region of its bending tools.
Figure 5:
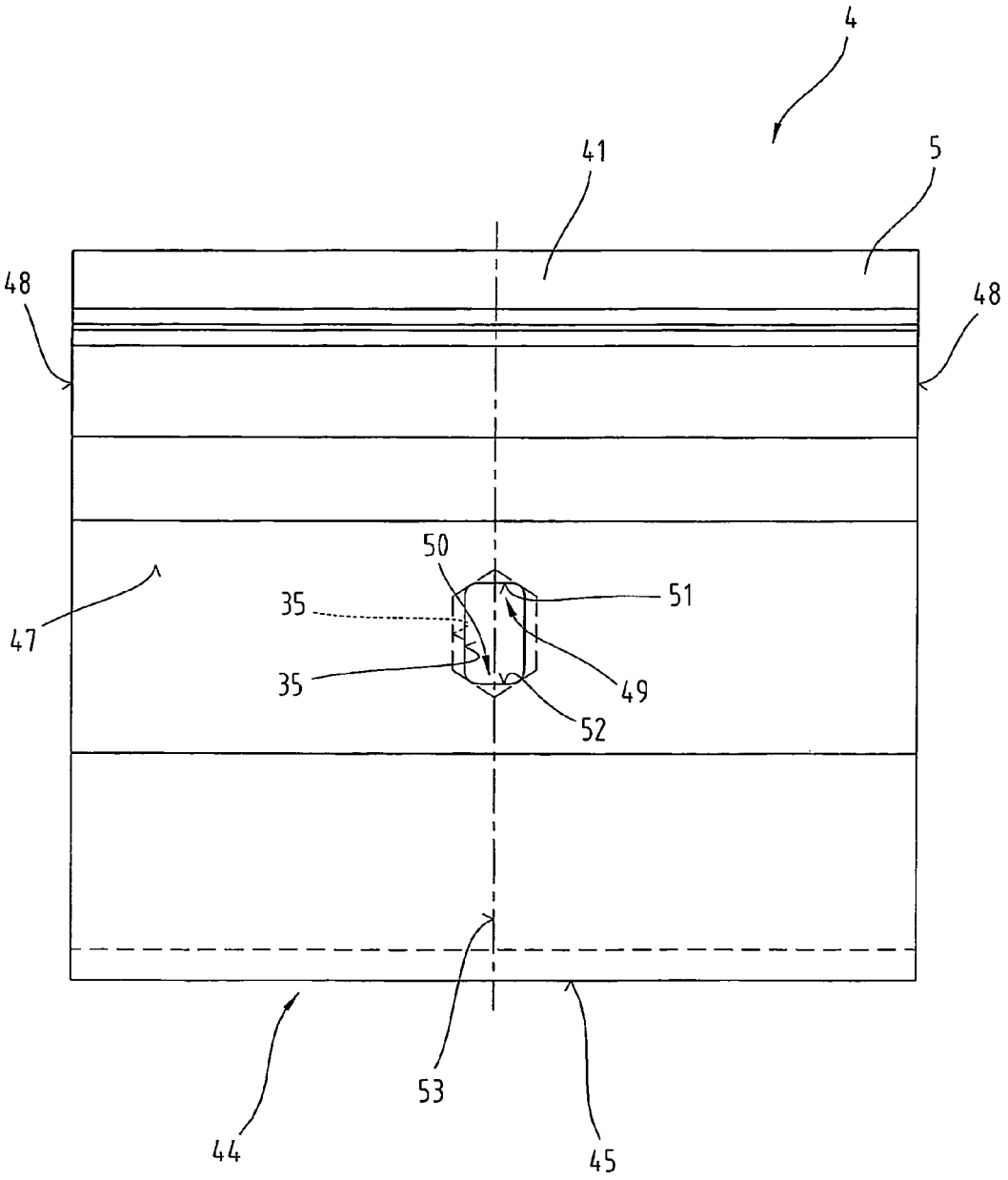
FIG. 5 shows the bending punch of the bending press illustrated in FIG. 4 viewed in the direction of arrow V indicated in FIG. 4.

FIGS. 4 and 5 illustrate one possible embodiment of the bending tool 4 which may be construed as an independent embodiment in its own right, and again the same reference numbers and component names are used to denote parts that are the same as those described with reference to FIGS. 1 to 3 above. To avoid unnecessary repetition, reference may be made to the more detailed description given above in connection with FIGS. 1 to 3.

As may be seen by comparing FIGS. 4 and 5 with FIG. 2, the bending tools 4 each have a headpiece 41 which is inserted in the tool holders 19, 20 in a clamping region 42. To this end, the tool holders 19, 20 have a receiving slot 43. Each of the bending tools 4 illustrated here further comprises an end region 44 spaced at a distance apart from the headpiece 41, which defines a bending region 45 in the longitudinal extension of the bending tool 4. Extending between the headpiece 41 and the end region 44 of the bending tool 4 is a tool arm 46. In the case of the embodiment illustrated as an example here, the tool arm 46 of the bending tool 4 constituting the bending punch 5 is provided in the form of several arms, although these are not illustrated.

The two tool holders 19, 20 of the pressing beam 13, 16 described above receive the headpiece 41 of the bending tool or tools 4, where they are held so that they can be interchanged. In the case of the bending tool 4 constituting the bending die 6, the tool arm between its headpiece 41 and the end region 44 is of a short and stumpy design, unlike the tool arm 46 of the bending punch 5.

The bending tools 4 formed by the bending punch 5 and bending die 6 are delimited in terms of their spatial shape by side walls 47 bounding them and in terms of the longitudinal extension by end walls 48 spaced at a distance apart from them.

The recess 35 illustrated here in the region of one of the side walls 47 of the bending tool 4 formed by the bending punch 5 has mutually spaced apart stop regions 49, 50. In the embodiment illustrated as an example here, the two stop regions 49, 50 are oriented vertically one above the other and in a vertical plane with respect to one another when the bending tool 4, in particular the bending punch 5, is in the normal position of use. Each of the stop regions 49, 50 in turn comprises at least one individual contact surface 51, 52. The stop regions 49, 50 and the contact surfaces 51, 52 bounded by them may be of any shape. By preference, they may complement the contact surfaces 40 of the gripping fingers 31, 32 described above. In the embodiment illustrated as an example here, the two contact surfaces 51, 52 are of an arcuately curved design. The two stop regions 49, 50 are preferably disposed in a reference plane 53 oriented in a direction perpendicular to the bending regions 45. In this case, this reference plane 53 is also oriented perpendicular to the longitudinal extension of the bending tool 4. Consequently, in the embodiment illustrated as an example here, the two stop regions 49, 50 are spaced at a distance apart from one another in the vertical direction relative to the bending region 45.

In order to obtain the clamping hold of the bending tool 4 by the gripping tongs 30 of the manipulator 28, the ends 38, 39 of the gripping fingers 31, 32 are inserted in the recess 35, 36. By prizing the gripping fingers 31, 32 open in the direction opposite that of the clamping force for holding the workpiece 2 to be produced, the two contact surfaces 40 lying outside against the gripping fingers 31, 32 are moved into contact with the two stop regions 49, 50.

Accordingly, it is possible for the bending tool 4 to be gripped and held by the same gripping fingers 31, 32 of the manipulator 28 as those used to hold and manipulate the metal sheet for forming the workpiece 2 without the need for any additional tools or additional manipulating means. Another advantage of this is that that no additional components have to be provided on the bending tool 4, such as pins, bolts, ribs or such like, to enable it to be manipulated by the gripping fingers 31, 32. The recess 35, 36 can be provided or formed by a simple processing operation, such as a milling operation for example. Consideration must be given to the disposition and size of the recess 35, 36 with a view to preserving appropriate properties in term of strength.

In order to obtain an oriented hold of the bending tool 4 due to the co-operation between the gripping fingers 31, 32 and recesses 35, 36, it is of advantage if the contact surfaces 51 and 52 of a stop region 49, 50 are disposed so that they extend towards one another on the side facing away from the other stop region 50, 49. A design of this type is indicated by broken lines in FIG. 5. This results in a self-centering effect of the two contact surfaces 40 on the contact surfaces 51, 52 co-operating with them. This not only results in a perfect clamping action but also enables an oriented hold to be obtained right from the start of picking up the bending tool 4 through to the point when it is ultimately positioned in the tool holders 19, 20 or tool depot. To this end, the contact surfaces 40 provided on the gripping fingers 31, 32 may be of a design complementing the stop regions 49, 50, in particular their contact surfaces 51, 52.

The recesses 35, 36 are preferably disposed in at least a side wall 47 of the bending tool 4 extending parallel with the bending region 45. If the thickness of the bending tool 4 were chosen accordingly, the recess 35, 36 could also be disposed in at least one of the end walls 48. In order to prevent an eccentric hold of the bending tool 4 on the gripping fingers 31, 32, it is of advantage if the recesses 35, 36 are disposed preferably centrally between the two end walls 48 disposed at a distance apart from one another in the longitudinal extension. This will result in a central disposition of the stop regions 49, 50 of the recess 35, 36 relative to the longitudinal extension of the bending tool 4.

Figure 6:
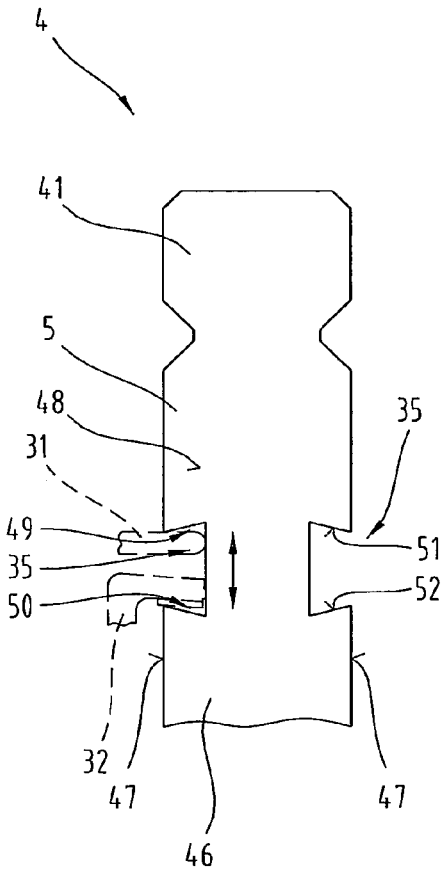
FIG. 6 is a side view on a larger scale illustrating a part-section of another bending tool incorporating a recess based on a different design.
Figure 7:
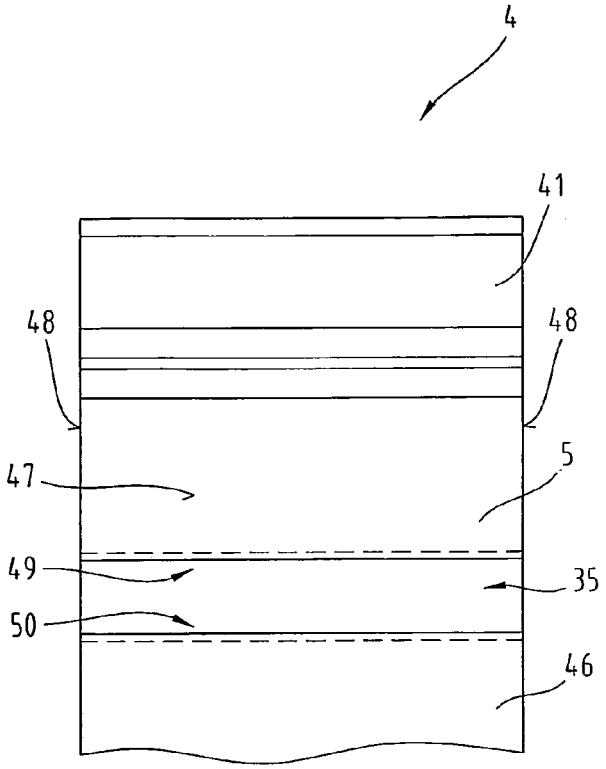
FIG. 7 is a front view of the bending tool illustrated in FIG. 6.

FIGS. 6 and 7 illustrate one possible and optionally independent embodiment of the bending tool 4, and again, the same reference numbers and component names are used to denote parts that are the same as those described in connection with FIGS. 1 to 5 above. To avoid unnecessary repetition, reference may be made to the detailed description given above with reference to FIGS. 1 to 5.

In this example of an embodiment, a bending punch 5 has also been selected as the bending tool 4. The recess 35 for co-operating with the gripping fingers 31, 32 of the gripping tongs 30 illustrated in this instance extends in the longitudinal direction of the bending tool 4. In this respect, it is preferable to opt for a parallel orientation relative to the bending region 45. Furthermore, the recess 35 may not only be disposed in one of the side walls 47 but also lying opposite. The recess 35 also preferably extends continuously across the entire longitudinal extension of the bending tool 4 between the two end walls 48. The recess 35 may be of a groove-shaped design. As viewed in cross-section, the recess 35 may be of a dovetail shape. This means that, starting from a groove base, the contact surfaces 51, 52 bounding the recess 35 extend towards one another in the direction towards the side walls 47.

The advantage of this is that if several recesses 35, 36 are provided in the bending tool 4, the bending tool 4 can be gripped and held from different positions. To this end, the recesses 35, 36 may be provided or disposed in oppositely lying side walls 47 of the bending tool 4.

However, this arrangement of the recess 35, 36 described here could also be selected on the basis of the embodiment illustrated in FIGS. 4 and 5. The stop regions 49, 50 would then be spaced apart from one another in a direction parallel with the longitudinal extension of the bending tool 4. In this case, the clamping hold is effected by the gripping fingers 31, 32 moving towards one another but in an orientation rotated by 90° compared with the holding action described above.

The embodiments illustrated as examples represent possible variants of the production system 1, in particular the bending tools 4 with the co-operating gripping fingers 31, 32, and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants which can be obtained by combining individual details of the variants described and illustrated are possible and fall within the scope of the invention.

For the sake of good order, finally, it should be pointed out that, in order to provide a clearer understanding of the structure of the part-feeding system, it and its constituent parts are illustrated to a certain extent out of scale and/or on an enlarged scale and/or on a reduced scale.

The objective underlying the independent inventive solutions may be found in the description.

Above all, the individual embodiments of the subject matter illustrated in FIGS. 1, 2; 3; 4, 5; 6; 7 constitute independent solutions proposed by the invention in their own right. The objectives and associated solutions proposed by the invention may be found in the detailed descriptions of these drawings.

| List of reference numbers | |
|---|---|
| 1 | Production system |
| 2 | Workpiece |
| 3 | Bending press |
| 4 | Bending tool |
| 5 | Bending punch |
| 6 | Bending die |

-continued

| List of reference numbers | |
|---|---|
| 7 | Machine frame |
| 8 | Base plate |
| 9 | Side panel |
| 10 | Side panel |
| 11 | Cross-member |
| 12 | Front end face |
| 13 | Pressing beam |
| 14 | Front end face |
| 15 | Linear guide |
| 16 | Pressing beam |
| 17 | End face |
| 18 | End face |
| 19 | Tool holder |
| 20 | Tool holder |
| 21 | Drive arrangement |
| 22 | Drive means |
| 23 | Power network |
| 24 | Control device |
| 25 | Input terminal |
| 26 | Spindle drive |
| 27 | Actuator means |
| 28 | Manipulator |
| 29 | Supply stack |
| 30 | Gripping tongs |
| 31 | Gripping finger |
| 32 | Gripping finger |
| 33 | Clamping surface |
| 34 | Clamping surface |
| 35 | Recess |
| 36 | Recess |
| 37 | Manipulator arm |
| 38 | End |
| 39 | End |
| 40 | Contact surface |
| 41 | Headpiece |
| 42 | Clamping region |
| 43 | Receiving slot |
| 44 | End region |
| 45 | Bending region |
| 46 | Tool arm |
| 47 | Side wall |
| 48 | End wall |
| 49 | Stop region |
| 50 | Stop region |
| 51 | Contact surface |
| 52 | Contact surface |
| 53 | Reference plane |

The invention claimed is:

1. A production system, for the free-form bending of workpieces, the production system comprising:

a bending press comprising:

a pressing beam; and tool holders, at least one bending tool, which is a one part unit, comprising:

a headpiece, which is interchangeably held in the tool holders of the pressing beam; and an end region being spaced apart from the headpiece, which defines a bending region extending in a longitudinal extension of the bending tool; and a tool arm extending between the headpiece and the end region; and side walls and end walls bounding the bending tool, a manipulator with gripping tongs having two gripping fingers, wherein the two gripping fingers have clamping surfaces on the side facing the workpiece to be produced to enable the workpiece to be produced to be gripped and held, at least one recess disposed in the tool arm of the bending tool for manipulating the bending tool, which recess extends in a longitudinal direction of the bending tool all the way from a first end wall to a second end wall of said end walls and which recess also pierces through said end walls, wherein additional contact surfaces are provided on ends of the gripping fingers respectively on sides of the clamping surfaces facing away from one another, the recess has stop regions spaced at a distance apart from one another and the ends of the gripping fingers are inserted in the recess in order to produce a clamping hold of the bending tool wherein the recess is in a dovetail shape as taken along a cross-section;

the contact surfaces of the gripping fingers are pressed against the stop regions in a direction opposite the clamping force for holding the workpieces to be produced.

2. The production system according to claim 1, wherein the stop regions are spaced at a distance apart from one another in the direction perpendicular to the bending region.

3. The production system according to claim 1, wherein each of the stop regions has contact surfaces, and the contact surfaces of a stop region extend towards one another on the side facing away from the other stop region.

4. The production system according to claim 1, wherein the recess is disposed in at least one side wall of the bending tool extending parallel with the bending region.

5. The production system according to claim 1, wherein the stop regions of the recess are disposed centrally relative to the longitudinal extension of the bending tool.

6. The production system according to claim 1, wherein several recesses are provided in the bending tool.

7. The production system according to claim 1, wherein the recesses are disposed in oppositely lying side walls of the bending tool.

8. The production system according to claim 1, wherein the contact surfaces on the gripping fingers respectively complement the stop regions of the bending tool.

9. The production system according to claim 1, wherein the bending press is a press brake.

10. The production system according to claim 1, wherein the bending tool is a bending punch.

11. The production system according to claim 1, wherein the bending tool is a bending die.

12. The production system as in claim 1, wherein the bending unit is formed as one integral part.

13. The production system as in claim 12, wherein the dovetail shape of said recess is configured such that starting from said groove base, the contact surfaces bounding the recess extend towards one another in the direction towards the side walls.

14. The production system as in claim 13, wherein said tool arm of said bending tool has a substantially U-shaped pattern such that said tool arm bends around a longitudinal axis of an extension of the tool arm.

15. A bending tool for use in a production system with a press brake for bending workpieces having a tool holder which is coupled to a pressing beam and which production system has a manipulator with gripping fingers, the bending tool, which is a one part unit, comprising:

a tool arm;

a headpiece which is coupled to a first end portion of the tool arm and interchangeably held in the tool holder of the pressing beam of the press brake;

an end region which is coupled to a second end portion of the tool arm spaced apart from the headpiece and which is configured to produce a bending edge within the workpiece, wherein the end region is orientated so that the longitudinal extension of the tool body extends in direction of the bending edge;

a plurality of side walls bounding the bending tool parallel to the longitudinal extension;

a plurality of end walls bounding the bending tool perpendicular to the longitudinal extension;

at least one recess which is formed as groove, being disposed in one of the side walls of the tool arm of the bending tool configured to allow manipulation of the bending tool by the gripping fingers of the manipulator, which recess extends in a longitudinal direction of the bending tool all the way from a first end wall to a second end wall of said end walls and which recess also pierces through said end walls; the recess having stop regions spaced at a distance apart from one another, which are coupled to one of the side walls of the tool arm;

a groove base which bounds the recess at a distance to one of the side walls of the tool arm and which is connected to the stop regions, wherein the distance between the stop regions on the groove base is greater than the distance between the stop regions on the side wall;

the bending unit is formed as one integral part wherein the recess is formed in a dovetail shape as viewed in a cross section.

16. The bending tool according to claim 15, wherein the end region is a working unit.

17. The bending tool according to claim 15, further comprising at least one additional recess which is disposed opposite to the at least one recess on the side wall of the of the tool arm of the bending tool configured to allow manipulation of the bending tool by the gripping fingers of the manipulator.

18. The bending tool as in claim 15, wherein the dovetail shape of said recess is configured such that starting from said groove base, the contact surfaces bounding the recess extend towards one another in the direction towards the side walls.

19. The bending tool as in claim 18, wherein said tool arm of said bending tool has a substantially U-shaped pattern such that said tool arm bends around a longitudinal axis of an extension of the tool arm.

* * * * *